United States Patent [19]

Martucci

[11] 4,315,595

[45] Feb. 16, 1982

[54] MULTI-APARTMENT REMOTE TIME VARIABLE TEMPERATURE REGULATOR AND RECORDER

[76] Inventor: Frank C. Martucci, 360 Tom Hunter Rd., Fort Lee, N.J. 07024

[21] Appl. No.: 94,384

[22] Filed: Nov. 15, 1979

[51] Int. Cl.[3] ..... F23N 5/20; G05D 23/00

[52] U.S. Cl. ..... 236/46 R; 236/94; 337/301

[58] Field of Search ..... 236/46 R, 94; 165/12, 165/22; 200/29; 337/301-304

[56] References Cited

U.S. PATENT DOCUMENTS 2,279,107 4/1942 Cahn ..... 236/46 R X 3,258,552 6/1966 Harris ..... 337/302 X

*Primary Examiner*—William E. Wayner

*Attorney, Agent, or Firm*—Peter C. Michalos; Constantine A. Michalos

[57] ABSTRACT

A temperature control and monitoring device for a heater of a building having a plurality of separate areas comprising, a motor having a shaft rotatable at constant speed, a disc connected to the shaft having a pluraliity of radially extending slots, a pin slidably mounted in each of the slots, a temperature indicator having a shaft rotatable by a change in temperature and responsive to a temperature sensed by temperature sensing members, a plurality of temperature sensing members, each in one of the separate areas, for sensing the temperature in each of the areas respectively connected to the temperature indicator and a selector device connected between each of the temperature sensing members and the temperature indicator for selectively connecting one of the sensing members at a time for a predetermined time period and at predetermined intervals to the temperature indicator. A control arm extends from and is connected to the indicator shaft and is engagable with at least one of the pins with a circuit connected to the control arm and the pins and also to the heater for starting the heater when the temperature indicator shaft rotates to permit the engagement between the control arm and at least one of the pins in response to a temperature sensed by the connected sensing member. The pins are positioned on the disc in a pattern to produce a selected temperature control for each full revolution of the motor which usually corresponds to one full day so that the heater is controlled according to temperatures sampled from each of the separate areas. A recording disc can also be connected to the first mentioned disc with a pen connected to the indicator shaft for keeping a permanent record of temperature variations among the separate areas.

16 Claims, 3 Drawing Figures

MULTI-APARTMENT REMOTE TIME VARIABLE TEMPERATURE REGULATOR AND RECORDER

FIELD AND BACKGROUND OF THE INVENTION

The present invention relates in general to thermostatic controls and, in particular, to a new and useful multi-apartment remote time variable temperature regulator and recorder.

The present state of the art in controlling temperatures in apartment houses utilize outdoor temperature sensing devices. These devices control the length of hourly firings of the heating system, reducing the length of time when the temperature outdoors is high and increasing the length of time when low. As outdoor temperatures increase, apartments may not require additional heat for a period of up to 3 or 4 hours to sustain adequate temperatures. The outdoor temperature control system, lacking an indoor thermostat, is unable to sense whether heat requirements have been satisfied. The result is three or four unnecessary short cycle firings, causing tenants to open windows for relief from excessive heat and an enormous waste of energy. This is especially true during the spring and fall, when there may be no need for heat during daytime hours for up to six hours.

Thermostats, sensing the true indoor temperatures of apartments, are the only proper devices for regulating the heat for apartment houses with the greatest efficiency. However, landlords cannot prevent tampering of thermostat settings by tenants. They place ice cubes on locked thermostats, may open windows, or eliminate night temperature settings by turning the clock ahead 12 hours to day temperature settings. On the other hand, a tenant doing an exceptional amount of baking or entertaining a large group of people can produce excessive heat causing the thermostat to be satisfied resulting in heat complaints from the remaining tenants.

Also pertinent to understanding the present invention is the inventor's previous patent application Ser. No. 923,067 filed July 10, 1978 entitled Time Variable Thermostat now U.S. Pat. No. 4,180,789 which patent is incorporated here by reference to permit full understanding of the present invention.

SUMMARY OF THE INVENTION

The present invention permits landlords to resort to room thermostat operation, without any tampering or heat complaints. The thermostat is located in a secure area outside the apartments. Thermister leads are installed from the thermostat to several or all apartments. Thermistors are installed behind thermometers in each apartment. The invention permits 2, 3, 4, or more apartments to be connected to the thermostat at timed intervals. For example, apartment A is connected to the thermostat on an even hour. The windows were open, therefore for that timed interval, the heat will come on. The recorder will have made a record of that apartment's temperature during that timed interval. Now apartment B is switched to the thermostat. That apartment's temperature will be recorded, and if adequate, the heating system will be switched off. Apartment C may be overheated from baking which will also keep the heating system shut down. In other words, no single apartment can create an enormous waste of energy since within 15 to 30 minutes another apartment will be monitored to shut the heating system down. In addition, the permanent recording will provide the landlord with proof of any abuse. The permanent recording will also verify false heat complaints by tenants who sleep with windows open and then expect the heat to be maintained at the same temperature as other apartments. It will also verify adequate temperatures in apartments where tenants complain when heat is an adequate 70 degrees.

Accordingly an object of the present invention is to provide a temperature control and monitoring device for a heater of a building having a plurality of seperate areas comprising, a motor having a shaft rotatable at constant speed and preferrably once in twenty-four hours, a disc connected to the shaft having a plurality of radially extending slots, pin means slidable on each of said slots, a temperature indicator having a shaft rotatable by a change in temperature and responsive to a temperature sensed by temperature sensing members, a plurality of temperature sensing members each in one of the seperate areas for sensing the temperature in each of the areas respectively connected to said temperature indicator, selector means connected between said plurality of temperature sensing members and said temperature indicator for selectively connecting one of said sensing members at a time for a predetermined time period and at predetermined intervals to said temperature indicator, a control arm connected to said temperature indicator shaft and engagable with at least one of said pin means, and circuit means connected to said control arm, said pin means and the heater for starting the heater when the temperature indicator shaft rotates to engage said control arm with at least one of said pin means in response to the temperature sensed by said connected sensing member, said pin means positioned on said disc in a pattern to produce a selected temperature control for each full rotation of said motor shaft, whereby the heater is controlled in accordance with temperatures sampled from the seperate areas at the predetermined intervals.

Another object of the present invention is to provide a chart over said disc and a pen mounted to said temperature indicator shaft for writing on said chart to indicate the temperature sensed in the seperate areas so that a permanent record of the temperature in the various areas is kept.

A further object of the present invention is to slidably connect the control arm to the indicator shaft and provide a lifting member rigidly connected to the shaft and engaged with the control arm so that the control arm is lifted when the indicator shaft rotates in one direction and released when the indicator shaft rotates in the opposite direction and the control arm engages one of the pin means.

A still further object of the invention is to provide a multi-apartment remote time variable temperature regulator and recorder which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and description matter in which there is illustrated a preferred embodiment of the invention.

DESCRIPTION OF THE PREFERRED EMBODIMENTS

Figure 1:
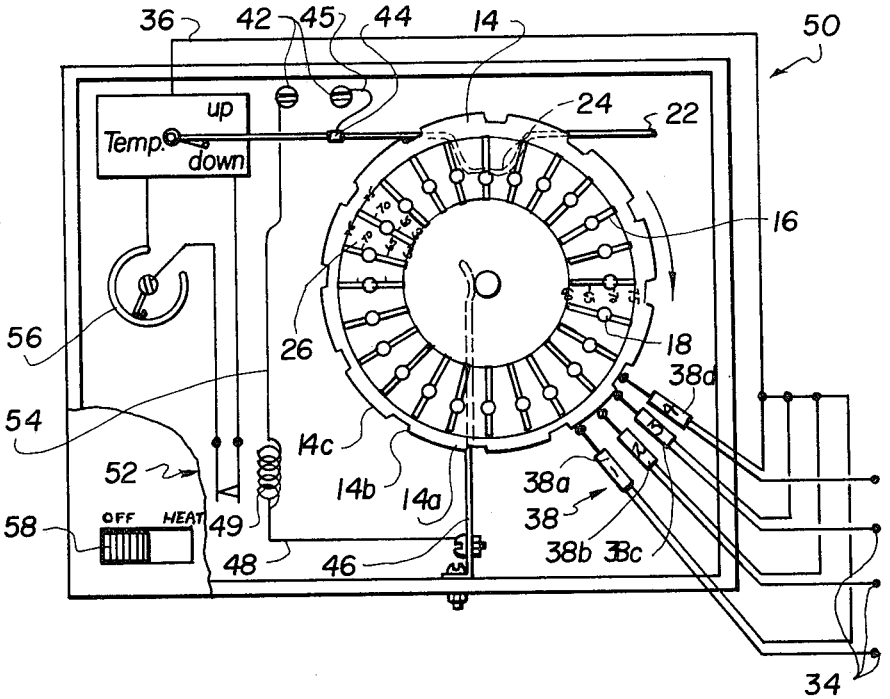
FIG. 1 is a front elevational view with portions cut away of the temperature control in accordance with the invention.
Figure 2:
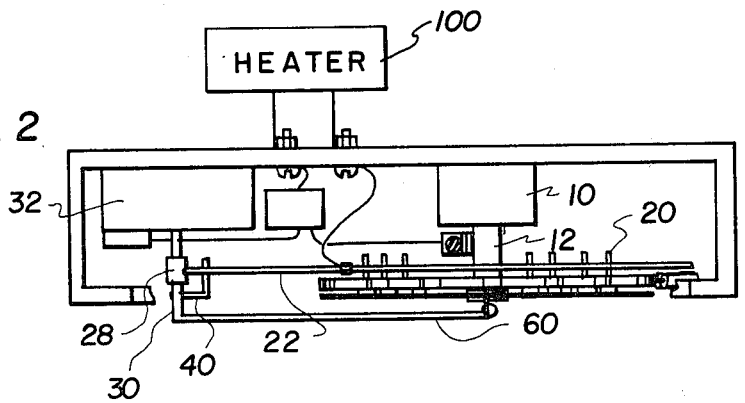
FIG. 2 is a top plan view of the embodiment shown in FIG. 1.

Turning to the drawings in particular, the invention embodied therein, comprises a temperature control and monitoring device or multi-apartment remote time variable temperature regulator and recorder generally designated 50 comprising a motor 10 best seen in FIG. 2 which preferrably is a clock motor having a shaft 12 which rotates once in twenty-four hours. Rigidly connected to shaft 12 is a disc 14 which in one preferred embodiment of the invention, is made of electrically conductive material such as aluminum or sheet steel. As with the inventor's previous patent entitled Time Variable Thermostat identified above, the disc 14 includes a plurality of radially extending slots 16 which each have engaged therein a pin or pin means 18 which either may be a simple plastic pin having a portion engaged in the slots 16 with a tail portion 20 best shown in FIG. 2 which are selectively engagable with a control arm 22. As shown in FIG. 1, control arm 22 includes an off-set or angles portion 24 which extends downwardly to engage with the tail portion 20 of the pins 18 to prevent the arm 22 from becoming entangled in the tail portions and defeat the functioning of the device.

As best explained in the inventor's previous patent identified above, the pins 18 are selectively positioned in the slots which correspond to temperature settings read off an annular scale shown at 26. This provides a gradation of temperature changes rather than abrupt temperature changes as in prior art thermostats.

In the present invention, control arm 22 is connected to a sleeve 28 which is loosely mounted on shaft 30 of a temperature indicator 32 which is an electronic thermometer or the like which is well known in the art. Shaft 30 rotates in response to a sensed temperature which is provided by one of the four temperature sensing members 34 which are each positioned in one of a plurality of areas of the dwelling to be heated for example, seperate apartments of a multi-apartment building. In accordance with the invention, the sensing members are best hidden behind a thermometer to avoid tampering by tenants. Each temperature sensing member, which is for example, a temperature transducer, which changes resistance in accordance with temperature changes, is connected to the temperature indicator 32 through a line 36. Between line 36 and the sensors 34 is a selector means generally designated 38 which comprises individual switches 38*a* through 38*d*. The temperature sensing members 34 are selectively connected to the temperature indicator 32 by the activation of one of switches 38*a* through 38*d* of the selector means 38. These switches are selectively activated for a selected period of time and at selected intervals by providing on the periphery of disc 14 a cam surface 14*a* having spaced indentations 14*b* and raised portions 14*c*. The indentations 14*b* are positioned so that only one switch 38*a* through 38*d* is activated at a time to connect only one sensing member 34 to the indicator 32 at a time.

In the embodiment shown, twenty four slots 16 are provided on the disc to change or control the temperature once per hour in a twenty four hour day. The motor 10 rotates once per day however these spacings and time relationships can be changed without departing from the principle of the invention. In the embodiment shown, the indentations 14*b* span the radial distance equivalent to one half an hour and the raised portion 14*c* spans one and a half hours so that each apartment is sampled for its temperature for one half an hour every two hours. The number of switches 38*a* to 38*d* can also be changed to accommodate more or fewer apartments with the spacing and size of the indentations and raised portions of cam surface 14*c* changed accordingly. The time for sampling can also be changed to accommodate more sensing members 34.

In the embodiment shown, an increase in temperatures as senced by the connected sensing member 34 causes the shaft 30 of indicator 32 to rotate in a counterclockwise direction shown in FIG. 1. Control arm 22 is then caused to rotate in a clockwise direction since it is engaged by a raising post 40 which is rigidly connected to the shaft 30. If a temperature decrease is sensed, the indicator shaft 30 as shown in FIG. 1 turns clockwise and, after the control arm 22 engages the uppermost one or two pin tails 20 the shaft 30 is permitted to continue its clockwise rotation since the raising post 40 disengages from the control arm 22.

At the point when the control arm 22 engages with one of the pin tails 20 it completes a circuit which energizes a heater 100 through a boiler or furnace relay having posts 42. The control arm 22 thus acts as a contact of a switch for energizing the heater. It is noted that the principle of the invention can also be used for energizing air conditioning or cooling plants as well as heating plants.

In an alternate embodiment of the invention the switch for turning the heating unit on may comprise raising post 40 as one contact and control arm 22 as the other contact. Wire leads may be connected to these two contacts and to a circuit for turning the heater on when the raising post 40 engages the control arm 22. In such an embodiment the functioning of the temperature indicator is reversed so that control arm 22 rotates clockwise as the sensed temperature increases.

Continuity for energizing the heater is produced by forming the arm 22 in at least at a point beyond its junction 44 with wire 45 of electrically conductive material. Pins 18 are also electrically conductive as is the disc 14. Shaft 12 is also electrically conductive and has a spring contact 46 bearing thereagainst which is connected to a wire 48 through a coil 49 of a relay generally designated 52, to a line 54 which is connected to the other heater relay post 42. Relay 52 is utilized to open the circuit of a temperature differential adjustment 56. Temperature adjustment 56 comprises a variable resister connected in series with the line 36 so that when the heater is activated by the engagement of control arm 22 with the pin to close the control circuit, increased resistance is applied to that already provided by the temperature sensing members 34 to cause the temperature indicator 32 to read a temperature one or two degrees lower that the actual temperature so that the heater is not needlessly turned on and turned off at close intervals. This decrease in sensitivity for the temperature indicator is a standard feature of prior art temperature indicators.

An "on" "off" switch 58 is also provided for bypassing the thermostat 50 and turning the heater on manually.

Figure 3:
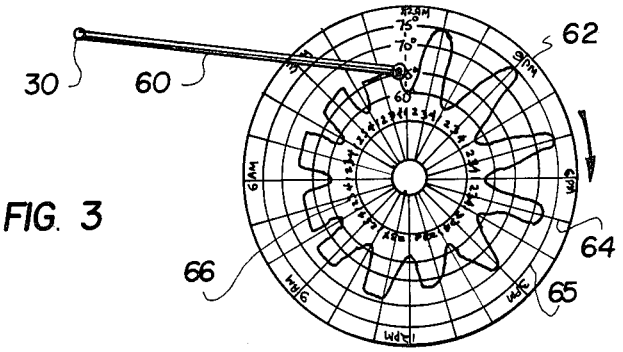
FIG. 3 is a front partial elevational view of the time chart and pen arm used in accordance with the invention.

As best seen in FIG. 2, shaft 30 of the temperature indicator 32 also includes a pen arm 60 having a pen time which is adapted to write on a chart for example a pen tip similar to that used in a chart barometer or the like. As seen in FIG. 3, a chart disc 62 which may be of card board or paper can be positioned over the end of shaft 12 covering the ends of pins 18 and including radial divisions 64 indicating time intervals, those intervals shown being one hour intervals and circumferential divisions 65 indicating temperature gradiants with the outermost division representing 75 degrees and the inner most division representing 60 degrees. Also shown on an inner concentric circle 66 is the designation of each apartment serviced by each of the temperature sensing members 34. In accordance with the invention disclosed in FIG. 1, each apartment is sensed for its temperature once every half hour so that a running record of each sampling is kept by the movement of pin arm 60 connected rigidly to indicator shaft 30. As shown by the chart of FIG. 3, apparently an excessively high temperature existed in apartment 3 which is about 75 degrees from the hours of around 6 PM to 11 PM. Conversely, an extremely low temperature below 60 degrees has existed in apartment 1 for the entire 24 hour period. This may indicate an open window or the like or some tampering by someone occupying that apartment. A running record therefore of the temperature in each apartment can be kept as well as a control of the heating in the entire building according to the temperatures sampled at selected spaced time intervals in the various apartments.

While specific embodiments of the invention have been shown and described in detail to illustrate the application of the principles of the invention, it will be understood that the invention may be embodied otherwise without departing from such principles.

What is claimed is:

1. A temperature control and monitoring device for a heater of a building having a plurality of seperate areas comprising:

a motor having a shaft rotatable at constant speed, a disc connected to said shaft having a plurality of radially extending slots, pin means slidable in each of said slots an positionable at a selected radial position, a temperature indicator having a shaft rotatable by a change in temperature and responsive to a temperature sensed by temperature sensing members, a plurality of temperature sensing members, each in one of the seperate areas, for sensing the temperature in each of the areas respectively, connected to said temperature indicator, selector means connected between said plurality of temperature sensing members and said temperature indicator for selectively connecting one of said sensing members at a time for a predetermined time period and at predetermined intervals to said temperature indicator, a control arm connected to said temperature indicator shaft and engagable with at least one of said pin means, and circuit means connected to said control arm, said pin means and the heater for starting the heater when the temperature indicator shaft rotates to engage said control arm with said at least one pin means in response to the temperature sensed by said connected sensing member, said pin means positioned on said disc in a pattern to produce a selected temperature control for each full rotation of said motor shaft, whereby the heater is controlled in accordance with temperature sampled from the seperate areas.

2. The temperature control and monitoring device according to claim 1 wherein said motor comprises a clock motor with said shaft rotatable one revolution every 24 hours.

3. A temperature control and monitoring device according to claim 1 further including differential adjustment means connected to said temperature indicator and to said circuit means for producing a temperature indication in said temperature indicator which is lower than said sensed temperature.

4. A temperature control monitoring device according to claim 1 wherein said circuit means comprises a switch having one contact formed by said control arm, said control arm made of electrically conductive material, and another contact formed by each of said pin mean respectively, said pin means made of electrically conductive material.

5. A temperature control and monitoring device according to claim 4 wherein said circuit means further comprises said disc made of electrically conductive material, said motor shaft made of electrically conductive material and a spring engaged with said motor shaft and adapted to be connected to said heater.

6. A temperature control and monitoring device according to claim 1 further including a chart disc connected to said former mentioned disc, a pen arm connected to the shaft of said temperature indicator having a writing end engaged with said chart disc whereby a written record is made of said sensed temperature.

7. A temperature control and monitoring device according to claim 4 wherein said control arm is electrically insulated from said temperature indicator shaft.

8. A temperature control and monitoring device according to claim 1 wherein said selector means comprises a plurality of switches connected to said temperature sensing members respectively and a cam defined on the outer periphery of said disc for selectively actuating one of said switches at a time to connect one of said temperature sensing members to said temperature indicator at a time.

9. A temperature control and monitoring device according to claim 1 further including a thermometer in each of the seperate areas, said temperature sensing members disposed behind each of said thermometers respectively whereby the purpose of said temperature sensing members is camouflaged.

10. A temperature control and monitoring device according to claim 1 wherein said pin means comprises a pin member slidably mounted in each of said slots of said disc having a tail portion extending beyond said disc and engagable with said control arm.

11. A temperature control and monitoring device according to claim 1 further comprising a raising post fixedly mounted to said temperature indicator shaft and wherein said circuit means comprises a switch having one contact formed by said control arm and another contact formed by said raising post.

12. A temperature control device for a heater of a building comprising:

a motor having a shaft rotatable at constant speed, a disc connected to said shaft having a plurality of outwardly extending slots, pin means slidable in each of said slots and positionable at any selected radial position along said slots, a temperature indicator having a shaft rotatable by a change in temperature and responsive to a temperature sensed by a temperature sensing member, at least one temperature sensing member, for sensing the temperature in the building, connected to said temperature indicator, a control arm connected to said temperature indicator with at least one of said pin means, and circuit means connected to said control arm, said pin means and the heater for starting the heater when temperature indicator shaft rotates to engage said control arm with said at least one pin means in response to the temperature sensed by said connected sensing member, said pin means positioned on said disc in a pattern to produce a selected temperature control for each full rotation of said motor shaft, whereby the heater is controlled in accordance with the temperature sensed in the building.

13. A temperature control device according to claim 12 wherein said circuit means comprises a switch having one contact formed by said control arm, said control arm made of electrically conductive material, and another contact formed by each of said pin means respectively, said pin means made of electrically conductive material.

14. A temperature control device according to claim 12 wherein said circuit means comprises a switch having one contact formed by said control arm, said control arm made of electrically conductive material, and another contact formed by a control arm raising post connected to said temperature indicator and engagable with said control arm.

15. A temperature control and monitoring device for a heater of a building comprising:

a motor having a shaft rotatable at constant speed, a disc connected to said shaft having a plurality of outwardly extending slots, pin means slidable in each of said slots and positionable at a selected radial position, a temperature indicator having a shaft rotatable by a change in temperature and responsive to a temperature sensed by a temperature sensing member, a temperature control arm affixed to an insulated sleeve, said sleeve loosely engaged to said temperature indicating shaft, a temperature control arm raising post affixed to said temperature indicator shaft, at least one temperature sensing member, for sensing the temperature in the building, connected to said temperature indicator, said control arm engaged with at least one of said pin means, and circuit means connected to said control arm, said pin means and the heater for starting the heater when temperature indicator shaft rotates to engage said control arm with said at least one pin means in response to the temperature sensed by said connected sensing member, said pin means positioned on said disc in a pattern to produce a selected temperature control for each full rotation of said motor shaft, whereby the heater is controlled in accordance with the temperature sensed in the building, a chart disc connected to said former mentioned disc, and a pen arm connected to said shaft of said temperature indicator having a writing end engaged with said chart disc whereby a written record is made of said sensed temperature.

16. A temperature control device according to claim 15 wherein said circuit means comprises a switch having one contact formed by said control arm, said control arm made of electrically conductive materials, and another contact formed by a control arm raising post connected to said temperature indicator and engagable with said control arm.

* * * * *